United States Patent [19]

Ruppert et al.

[11] Patent Number: 4,579,681

[45] Date of Patent: Apr. 1, 1986

[54] LAUNDRY DETERGENT COMPOSITION

[75] Inventors: Ronald M. Ruppert, Moonachie; Lenore E. Savio, West Milford, both of N.J.

[73] Assignee: GAF Corporation, Wayne, N.J.

[21] Appl. No.: 669,565

[22] Filed: Nov. 8, 1984

[51] Int. Cl.[4] ..... C11D 3/28; C11D 7/32

[52] U.S. Cl. ..... 252/542; 252/174.17; 252/174.23; 252/523; 252/524; 252/541; 252/DIG. 2; 252/DIG. 15

[58] Field of Search ..... 252/174.23, 541, 542, 252/544, DIG. 2, DIG. 15, 174.17

[56] References Cited

U.S. PATENT DOCUMENTS

| | | | |
|---|---|---|---|
| 3,749,682 | 7/1973 | Tanner | 252/524 |
| 4,020,015 | 4/1977 | Bevan | 252/544 |
| 4,088,610 | 5/1978 | Bevan et al. | 252/541 |
| 4,174,304 | 11/1979 | Burns et al. | 252/545 |
| 4,444,561 | 4/1984 | Denzinger et al. | 8/137 |

*Primary Examiner*—Prince E. Willis

*Attorney, Agent, or Firm*—Marilyn J. Maue; Joshua J. Ward

[57] ABSTRACT

A laundry detergent composition containing an effective amount of a soil release agent comprising a vinyl caprolactam resin and a standard detergent formulation.

11 Claims, No Drawings

LAUNDRY DETERGENT COMPOSITION

It is known that textiles and fibers derived from various synthetic fibers inherently tend to be hydrophobic and readily accumulate soil of a fatty, greasy or oily nature which is difficult to remove. It is therefore desirable to launder the fabric and in so doing to modify the textile or fiber surface so as to render it more hydrophilic and consequently more resistant to soiling with oil, grease or fatty type agents and also more receptive to oil and grease removal in subsequent washings. While textiles derived from cellulosic and other natural occuring fibers are not inherently hydrophobic, they are often rendered so by treatment with various finishing agents, e.g. durable press resins. To overcome the tendency for oil and grease soil penetration, thin films of modified cellulose ethers have been employed to coat the fabric surface and render it less oleophilic. Deposition of such films can be achieved by exhaustion onto the fabric from a laundry detergent when the soil release agent possesses sufficient fabric substantivity under laundering conditions.

While the modified cellulose ethers are capable of improving soil release, they are not particularly fabric substantive at low temperatures often encountered in a normal laundry wash or rinse cycle. More specifically, the cloud point of the cellulose ethers is generally quite high, from about 110° F. to about 120° F. and the resin requires a temperature of from about 120° F. to about 140° F. for fabric deposition in the coating medium, e.g. an aqueous detergent composition or a laundry additive.

Because of their limited fabric substantivity, except at relatively high temperatures, build-up of fabric soil resistance toward subsequent contact with oily or greasy substances is not easily attained.

It is an object of the present invention to provide an improved detergent composition which acts as a release agent for oily, greasy or fatty soiling agents.

Another object of the invention is to provide a resin which is deposited on fabric from a dilute aqueous laundry detergent or laundry additive solution onto the surface of a fabric at a relatively low temperature.

Another object of the invention is to minimize soil redeposition on fabrics by means of treatment with an oleophobic soil release resin of the present invention.

Still another object of this invention is to render a polyester fabric more receptive to cotton brighteners by washing and thereby modifying the polyester surface with a film of the present resin.

These and other objects and advantages of this invention will become apparent from the following description and disclosure.

According to this invention, there is provided a laundry detergent composition having a reduced soil-redeposition effect and enhanced oleo release properties. This composition comprises essentially at least one of anionic, nonionic, amphoteric or zwitterionic detergent active compounds in a detergent formulation and a polymer of N-vinylcaprolactam, preferably N-vinyl-e-caprolactam (VCL), which polymer includes N-vinylcaprolactam homopolymer and its copolymers or terpolymers with minor amounts of at least one of N-vinylpyrrolidone (VP); an ammonium derivative monomer of 6–12 carbon atoms of the group: dialkylaminoalkyl -acrylamide, -methacrylamide, -acrylate or -methacrylate and dialkyl dialkenyl ammonium halide; and stearyl -acrylate or -methacrylate. The vinyl caprolactam polymer is utilized in the form of a resinous substance, which may also include mixtures of the vinyl caprolactam polymer with other soil release agents. In cases where the vinyl caprolactam polymer is composed of more than one monomer, those polymers containing between about 65 and about 95 wt % N-vinyl-e-caprolactam; between about 5 and about 35 wt % N-vinyl2-pyrrolidone and 0 to about 10 wt % dimethylaminoethyl methacrylate (DMAEMA), are most preferred. Specific examples of some preferred resins having high soil releasing properties include:

80 wt % VCL/20 wt % VP
65 wt % VCL/35 wt % VP
65 wt % VCL/30 wt % VP/5 wt % DMAEMA
80 wt % VCL/15 wt % VP/5 wt % DMAEMA
VCL homopolymer The present vinylcaprolactam polymers are useful over a wide molecular weight range, e.g. a number average molecular weight of from about 1,000 to about 1,000,000, depending upon the particular monomer content and the flexibility desired or required for a given application. For example, the degree of flexibility needed for upholstery is far less than is required for clothing fabric; accordingly the former can utilize or tolerate a film of a less flexible polymer or a thicker coating of the anti-soiling agent.

The vinylcaprolactam polymers of this invention are known, as are their methods of preparation which are disclosed in U.S. Pat. Nos. 2,806,848; 4,057,533 and in co-pending patent application Ser. No. 440,648, filed Nov. 10, 1982.

In general, the copolymers are conveniently prepared by subjecting the above monomers, either in admixture or added sequentially into a reactor, to a temperature of between about 40° C. and about 120° C. under from about 10 psig. to about 150 psig. for a period of from about 0.5 to about 10 hours in the presence of a free radical polymerization catalyst, such as organic and inorganic peroxides, e.g. hydrogen peroxide, t-butyl peroxide or an azo compound e.g. azobisisobutyronitrile, 2,2'-azobis-(2,4-dimethyl valeronitrile) etc. The polymerization is beneficially effected with agitation in solution, suspension or emulsion wherein the reaction medium is alcohol, benzene, hexane, water or any mixture thereof. The polymeric product is separated and recovered by precipitation and filtration, distillation, decantation, evaporation of solvent or any other conventional method. The vinyl caprolactam homopolymer can be prepared similarly; however, it is to be understood that other conventional methods of polymerizaton can be employed to provide the anti-soiling polymers of the present invention.

The present anti-soiling resins can be employed in the absence of other anti-soiling agents; however, blending of the vinyl caprolactam homopolymer or terpolymer with conventional anti-soil agents is also beneficial. The presence of a vinyl caprolactam polymer significantly improves the properties of the conventional agents with which vinyl caprolactam is compatible. Particularly, cloud point, textile substantivity, prolonging activity of anti-soiling properties through several wash cycles etc. are improved. Conventional anti-soiling resins with which the present polymers are compatible are organic agents and include modified cellulose ethers as shown in U.S. Pat. Nos. 4,100,094, 4,379,061 and 4,441,881; hydroxyl terminated polyurethanes as disclosed in U.S. Pat. No. 3,660,010; the polycarboxylate polymer mixtures of U.S. Pat. No. 3,836,496; the polymers of vinylidene ester/unsaturated acids or anhydrides of U.S. Pat. No. 3,563,795; fluorocarbon polymers disclosed in U.S. Pat. No. 3,598,515, and the like. Of these supplementary anti-soiling agents, modified cellulose ethers, e.g. hydroxyalkyl alkyl cellulose ethers are preferred. Illustrative Examples of such ethers include those wherein the alkyl or mixed alkyl groups have between 1 and 6 carbon atoms, e.g. hydroxypropyl methyl cellulose ether, methyl cellulose ether, hydroxybutyl methyl cellulose ether, etc. One or more properties of the above conventional soil release agents can be improved with incorporation of as little as 5 wt % of the present vinyl caprolactam resin. In general, the composition of the present invention may contain from 0 to about 95% by weight of at least one of the above conventional anti-soiling agents; however, where utilization of a blend is desired, from about 60/40 to about 40/60 part blends of vinyl caprolactam homopolymer or terpolymer/conventional anti-soiling agent is recommended.

The concentration of the present soil release agent in the standard detergent formulation of this invention may vary between about 0.002 and about 2.0 weight percent, preferably between about 0.005 and about 0.5 weight percent, of the composition on a dry basis. It is to be understood, however, that the soil release resin can be added and mixed with the dry composition or it can be introduced into a concentrate or dilute detergent aqueous solution. During the washing or rinsing cycle, the present detergent composition or laundry additive generally comprises from about 0.05 to about 0.5 of the aqueous solution.

Detergent-active compounds in the standard detergent formulation of the present invention include anionics, such as water soluble alkali metal salts of organic sulphonates or sulfuric acid esters containing $C_{8-22}$ alkyl radicals. Examples of such synthetic anionic detergent-active compounds are sodium or potassium alkyl sulphuric acid esters, in particular those which can be prepared by sulphation of $C_8$–$C_{18}$-fatty alcohols, which can be obtained by reduction of fatty acids originating from tallow or coconut oil, or from synthetic alcohols prepared e.g. by Ozo- or Ziegler-synthesis; sodium or potassium-alkyl ($C_9$–$C_{20}$)-benzene sulphonates, in particular sodium linear or secondary alkyl ($C_{10}$–$C_{15}$)-benzene sulphonates; sodium or potassium alkyl-polyglycolether sulphuric acid esters, particularly from ethers of the higher alcohols which are obtained from tallow or coconut oil or of synthetic higher alcohols; sodium or potassium salts of carboxylic acid monoglyceride sulphates or sulphonates; reaction products of fatty acids, e.g. tallow or coconut fatty acid, with isethionic acid and neutralized with sodium or potassium hydroxide; sodium and potassium salts of fatty acid amides of methyl taurine; alkane monosulphonates, such as those obtained by conversion of $C_8$- to $C_{20}$ -alpha-olefins with sodium hydrogen sulphite or by conversion of paraffins with $SO_2$ and $Cl_2$ or $O_2$ and subsequent hydrolysis with sodium or potassium hydroxide; as well as olefin sulphonates, by which term the material is to be understood which is obtained by reaction of olefins, in particular alpha-olefins, with $SO_3$ and subsequent hydrolysis and neutralization. Anionic phosphate and non-phosphates are also suitable for the present detergent compositions.

Nonionic surfactants in both phosphate and non-phosphate detergents are equally suitable detergent active compounds for the present compositions. Examples in this group include the reaction products of alkylene oxide particularly ethylene oxide, with alkyl ($C_6$–$C_{12}$)-phenols, $C_8$- to $C_{20}$-alkanols, fatty acid amides, in which generally 5 to 30 ethylene oxide units are present per molecule, block polymerisates from propylene oxide and ethylene oxide, condensation products of ethylene oxide with reaction products from propylene oxide with ethylenediamine, etc. Other nonionic detergent active compounds comprise long-chain tertiary amine- or phosphine- oxide and dialkyl-sulphoxide.

Mixtures of detergent-active compounds, e.g. mixed anionic and mixed anionic and nonionic compounds can be incorporated in the detergent compositions, in particular in order to impart thereto controlled low-sudsing properties. This is particularly favourable for compositions to be used in automatic washing machines that do not allow foaming. Mixtures of amine oxides or quaternary compounds and ethoxylated, nonionic compounds can also be advantageous.

Many suitable detergent-active compounds are commercially available and have been described in literature, e.g. in "Surface Active Agents and Detergents" by Schwartz, Perry and Berch.

Amounts of amphoteric or zwitterionic detergent-active compounds can also be used in the compositions according to the invention; normally, however, because of their relatively high cost, when used, they are employed in small amounts in compositions built up from the more frequently used anionic or nonionic detergent-active compounds.

The present detergent formulations, on a dry basis, contain from about 5 to about 70% by weight, preferably from about 7 to about 20% by weight of the detergent active compound. The detergent formulations can further contain builder salts. Preferably they have a reduced phosphate builder salt content and can even be free of phosphate builder salts. The builder salts used can be inorganic and/or organic builder salts with or without ion exchange resins, e.g. zeolite. The weight ratio of the builder salts to the detergent-active compounds generally ranges from about 1:20 to about 20:1, preferably from about 1:3 to about 10:1, and particularly from about 1:1 to about 5:1. Examples of suitable inorganic and organic builder salts are sodium and potassium carbonate, tetrasodium and tetrapotassium pyrophosphate, pentasodium and pentapotassium tripolyphosphate, polymetaphosphates, trisodium- and tripotassium- nitrilotriacetate, etherpolycarboxylates such as sodium glycolate-malonate, citrates, oxidized starch- and cellulose-derivatives, particularly those with dicarboxyl radicals, sodium alkenyl-($C_{10}$–$C_{20}$)-succinates, sodium sulpho fatty acids, alkali metal carbonates and -orthophosphates, sodium aluminosilicates, carboxymethyloxysuccinates. Also several of the above-mentioned polycarboxylates can be considered as builder salts. The preferred builder salts are the condensed phosphates, in particular sodium tripolyphosphate, which may be partly or completely replaced by one or more of the other builder salts mentioned above.

Other conventional materials can be present in the detergent compositions of the invention, e.g. additional soil-suspending agents, hydrotropes, corrosion inhibitors, colorants, perfumes, fillers, optical brighteners, enzymes, lather boosters, foam depressors, germicides, anti-tarnishing agents, fabric softeners, chlorine-releasing agents, nitrogen-releasing bleaching agents such as sodium perborate or percarbonate with or without peracid precursors, buffers and the like. The remainder of the detergent compositions consists of water, e.g. in the range of from about 5 to 15% in the pulverous detergent compositions.

The detergent compositions according to the invention can have any of the usual physical forms for such compositions, such as powders, beads, flakes, bars, tablets, noodles, liquids, pastes and the like. The detergent compositions or laundry additives are manufactured and used in the conventional way, for instance, in the case of powdered detergent compositions they can be made by spray-drying aqueous suspensions of the detergent components or by spray-mixing processes.

The anti-soiling laundry detergent compositions of the present invention may be used to treat a wide variety of fabrics made exclusively from synthetic polymer materials as well as blends of natural and synthetic fibers and also natural fibers rendered hydrophobic by finishing agents. Examples of synthetic fibers which may be successfully treated in the practice of the present invention include those made with polyamide, acrylic, polyolefin and polyester fibers, such as Nylon or Acrilan and an acrylonitrile such as Orlon. Blends of natural and synthetic fibers which may be successfully treated with the resins of the present invention include fabrics containing 50% polyester/50% cotton, 65% polyester/35% cotton, etc. Cellulose fibers such as viscose, regenerated cellulose, etc., also may be combined with cellulosic fibers. The present detergent compositions are most effective on fabrics of pure polyester and blends of polyester and cotton with a permanent press finish; although they may also be applied to natural fibers such as linen, wool, cotton and silk, if desired.

In practice the present invention involves intimately mixing the vinyl caprolactam resin or vinyl caprolactam resin mixture into a dry formulation, concentrate or aqueous washing solution of the detergent formulation. The fabric is then introduced into the solution and washed at a temperature close to, or preferably above the resin cloud point whereupon the resin, having greater affinity for the fabric, precipitates out of solution and deposits onto the surface of the fabric as an oil resistant shield or coating which guards against future soiling with oily materials. Since the present resin is more hydrophilic than the textile, and since it possesses limited solubility in aqueous solutions under laundering conditions, it is readily deposited onto the surface of the fabric where it is allowed to dry to an oil resistant shield. In these applications, the resin of the present invention also provides brightening effects for the fabrics so treated.

Suitable washing temperatures for utilization of the present laundry detergent compositions include a temperature between about 80° F. and about 150° F., preferably between about 95° F. and about 120° F. The pH of the initial washing solution is generally maintained between about 6 and about 12.5.

Having generally described the invention reference is now had to the following examples which set forth preferred embodiments of the invention. It is to be understood, however, that the scope of the invention embraces many modifications and variations which will become apparent from the foregoing description and disclosure and from the embodiments provided by the Examples.

EXAMPLES 1-5

The present vinyl caprolactam homopolymer and vinyl-e-caprolactam copolymers, in the proportions noted below were prepared by introducing a 45% ethanol solution of the monomers in the indicated proportions into a one liter, 4-neck round bottom glass flask which contains 0.04% of VAZO 52 (2,2'-azobis (2,4-dimethylpentane nitrile) as a catalyst. The reaction mixtures were stirred to maintain homogeneous conditions and polymerization was carried out under atmospheric pressure over a period of 12 hours with addition of catalyst to maintain 0.03% concentration. The reactions were initiated and allowed to run for the first 6 hours at 50° C., after which time the temperature was raised to 80° C. for the remaining 6 hours. In all cases the resinous products were obtained in at least 98% yield. The products were recovered and 0.25% aqueous solutions were prepared. These solutions, simulating dilution in a washing or laundering operation, were tested for clear/cloud point. The results of these tests, along with a leading soil release agent, METHOCEL, are reported as follows.

| EXAMPLE | VCPL RESIN | CLEAR/CLOUD POINT OF PRODUCT SOLUTION |
|---|---|---|
| 1 | VCPL/VP/DMAEMA (80/15/5) | 35-37° C. |
| 2 | VCPL/VP/DMAEMA (60/35/5) | 42-44° C. |
| 3 | VCPL/VP/DMAEMA (47.5/47.5/5) | 47-51° C. |
| 4 | VCPL/VP/DMAEMA (71/24/5) | 37-40° C. |
| 5 | VCPL homopolymer | 33° C. |
| | METHOCEL E4M (Supplied by Dow Chemical Co.) | 58-61° C. |

EXAMPLE 6

The product of Example 1 was mixed with hydroxypropyl methyl cellulose (METHOCEL E4M) to form a 50/50 resinous mixture. A 0.25% aqueous solution of this product was found to have a clear/cloud point of 36°-39° C. It was unexpected to find that dilution of METHOCEL by 50% with the present soil release agent resulted in such a significant decrease in cloud point. Further dilution to form a 25/75% mixture of Example 1 resin METHOCEL resulted in a similar clear/cloud point.

EXAMPLES 7 THROUGH 14

Polyester and 65/35 cotton/polyester, permanent press, swatches (4×4 inches) as noted in Table I, were individually washed in a 4 pot Terg-O-Tometer (100 rpm) with a detergent having the following composition:

| COMPONENT | WEIGHT % |
|---|---|
| Sodium Carbonate | 39.91 |
| Igepal CO—630* | 8.55 |
| Sodium Silicate (2.4 ratio) | 3.56 |
| Sodium Sulfate (anhy.) | 47.98 |

To the above composition, 0.1% (solids, basis detergent formulation) of a soil release agent noted on Table I was added.

The swatches were each washed for 15 minutes and rinsed twice for 2 minutes each time, after which the swatches were dried thoroughly. The washing, rinsing and drying operations with the same detergent/soil release agent composition, were repeated 5 times for each swatch. Each of the dried swatches were then stretched and fastened with an elastic band across the top of a 150 ml glass beaker on which was deposited 2 drops of dirty motor oil (10 W 40 Quaker State, 5,000 mile use in a 4 cylinder auto engine) which was diluted 50% with mineral oil (Penreco). The oil deposits were allowed to wick for 2 hours, after which Reflectance readings (Rdf) were individually taken and recorded with a Gardner reflectometer.

Each of the swatches were subjected once more to a washing, rinsing and drying operation described above and the reflectance remeasured. The difference in reflectance, ΔRdf, is reported in following Table I.

The above described procedure was conducted at 100° F., 120° F. and 140° F. as noted in following Table I.

TABLE I

| EXAMPLE | SOIL RELEASE RESIN | FABRIC TESTED | ΔRdf at 100° F. | ΔRdf at 120° F. | ΔRdf at 140° F. |
|---|---|---|---|---|---|
| 7 | none - control | Polyester | 9.04 | 6.93 | 8.95 |
| | | Cotton/polyester, Perm. Press | 15.63 | 20.17 | 21.47 |
| 8 | 100% METHOCEL E4M | Polyester | 5.39 | 11.32 | 43.82 |
| | | Cotton/polyester, Perm. Press | 18.00 | 23.20 | 42.01 |
| 9 | Resin of Example 1 | Polyester | 10.33 | 17.36 | 11.25 |
| | | Cotton/polyester, Perm. Press | 23.49 | 23.31 | 38.24 |
| 10 | Resin of Example 2 | Polyester | 7.70 | 11.20 | 13.85 |
| | | Cotton/polyester, Perm. Press | 17.95 | 25.67 | 38.07 |
| 11 | Resin of Example 3 | Polyester | 6.80 | 8.79 | 7.71 |
| | | Cotton/polyester, Perm. Press | 17.32 | 23.00 | 35.83 |
| 12 | Resin of Example 4 | Polyester | 11.02 | 13.14 | 19.65 |
| | | Cotton/polyester, Perm. Press | 20.75 | 30.14 | 37.55 |
| 13 | Resin of Example 5 | Polyester | 14.58 | 40.71 | 19.26 |
| | | Cotton/polyester, Perm. Press | 28.08 | 39.79 | 42.43 |
| 14 | Resin of Example 6 | Polyester | 8.24 | 13.43 | 28.44 |
| | | Cotton/polyester, Perm. Press | 17.03 | 29.33 | 39.85 |

As shown in the foregoing Table, the vinyl caprolactam soil release agents of the present invention show, in many cases, unexpected improvement and in others equivalent preformance at low temperature washing when compared with the leading commercial soil release agent METHOCEL. At the higher was temperatures, 140° F. and above, this improvement is reversed. However, METHOCEL has a high cloud point, i.e. at about 140° F.; whereas the present soil release agents have significantly lower cloud points as indicated by Examples 1–5. Accordingly, METHOCEL requires a temperature of about 140° F. to exhaust from solution and deposit on the fabric. Since the lower wash temperatures are for below the METHOCEL cloud point, its deposition on fabric is extremely limited and poor soil release preformance results at these lower temperatures.

EXAMPLE 15

Two 4×4 inch padded swatches taken from padded textiles which had been dipped in a 2.5% aqueous solution of the resin of Example 4, were soiled with two drops of motor oil and measured for light reflectance. These swatches were then subjected to 5 successive wash cycles as described for Example 12 above, except that each was effected at 140° F. After drying, the swatches were remeasured for light reflectance and the increase in reflectance, or ΔRdf, reported as follows. The soil release effects of the present resin was compared with unpadded 4×4 inch swatches cut from the same fabric, which had been subjected to the above 140° F. washing cycles followed by drying. The ΔRdf for these unpadded swatches are also reported for purposes of comparison.

| SOIL RELEASE RESIN | FABRIC TESTED | ΔRdf |
|---|---|---|
| Control | 100% polyester | 8.95 |
| | 65/35 cotton/polyester (Permanent Press) | 21.47 |
| VCPL/VP/DMAEMA (71/24/5) | 100% polyester | 23.12 |
| | 65/35 cotton/polyester (Permanent Press) | 38.00 |

What is claimed is:

1. A laundry detergent composition comprising a standard detergent formulation and an effective soil releasing amount of N-vinylcaprolactam soil releasing agent selected from the group consisting of N-vinylcaprolactam homopolymer, copolymers, and terpolymers of predominantly N-vinylcaprolactam comprising a minor amount of at least one monomer selected from the group consisting of (1) N-vinylpyrrolidone, (2) dialkylaminoalkyl acrylamide, (3) dialkylaminoalkyl methacrylamide, (4) dialkylaminoalkyl acrylate, (5) dialkylaminoalkyl methacrylate, (6) dialkyl dialkenyl ammonium halide, (7) stearyl acylate and (8) stearyl methacrylate, or a blend of one or more of said N-vinylcaprolactam polymers with a conventional, supplementary antisoiling agent.

2. The composition of claim 1 wherein the supplementary anti-soiling agent is selected from the group of a cellulose ether, a hydroxylated polyurethane, a polycarboxylate polymer, a vinylidene ester/unsaturated acid or anhydride copolymer and a fluorocarbon polymer.

3. The composition of claim 1 wherein the N-vinyl caprolactam soil releasing agent is a blend of vinyl caprolactam resin and a hydroxyalkyl alkyl cellulose ether combined in a weight ratio between about 60:40 and about 40:60.

4. The composition of claim 3 wherein the hydroxyalkyl alkyl cellulose ether is hydroxypropyl methyl cellulose ether.

5. The composition of claim 1 wherein the detergent active agent is a non-ionic surfactant.

6. The composition of claim 1 wherein the detergent active agent and the N-vinyl caprolactam soil releasing agent are combined in a weight ratio of between about 7:1 and about 25:1.

7. The composition of claim 1 wherein the N-vinyl caprolactam soil releasing agent comprises between about 0.002 and about 2 weight percent of the total composition on a dry basis.

8. The composition of claim 1 wherein said soil releasing agent is a resin consisting essentially of between about 65 and about 100% weight percent N-vinyl caprolactam; between about 0 and about 35 weight percent N-vinylpyrrolidone; and between about 0 and about 10 weight percent dialkylaminoalkyl methacrylate optionally blended with between about 40 and about 60 weight percent of a hydroxylated alkyl cellulose ether.

9. The process for imparting soil release characteristics to a fabric comprising washing said fabric in the aqueous solution of the laundry detergent composition of claim 1 at a temperature of between about 80° F. and about 150° F., and rinsing and drying the washed fabric.

10. The process of claim 9 wherein the soil releasing agent of said laundry detergent composition is a resin copolymer of primarily N-vinyl caprolactam with a minor amount of N-vinyl-2-pyrrolidone said copolymer optionally blended with up to 95% of a hydroxyalkyl alkyl cellulose ether.

11. The process of claim 10 wherein said resin copolymer is blended with hydroxypropyl methyl cellulose ether in a weight ratio between about 40:60 and about 60:40.

* * * * *